US006084220A

United States Patent [19]

Suematsu et al.

[11] Patent Number: 6,084,220

[45] Date of Patent: Jul. 4, 2000

[54] CERAMIC HEATER

[75] Inventors: Yoshiro Suematsu, Aichi; Kikuo Sakurai; Yoshiro Noda, both of Gifu, all of Japan

[73] Assignee: NGK Spark Plug Co., Ltd., Japan

[21] Appl. No.: 09/177,648

[22] Filed: Oct. 22, 1998

[30] Foreign Application Priority Data

Oct. 28, 1997 [JP] Japan ..... 9-312698

[51] Int. Cl.[7] ..... F23Q 7/22

[52] U.S. Cl. ..... 219/544; 219/270; 338/252

[58] Field of Search ..... 219/544, 552, 219/553, 270; 338/252, 253, 262, 275

[56] References Cited

U.S. PATENT DOCUMENTS

| | | | |
|---|---|---|---|
| 3,694,626 | 9/1972 | Harden, Jr. | 219/544 |
| 3,978,183 | 8/1976 | Erickson | 219/544 |
| 4,101,760 | 7/1978 | Roller | 219/544 |
| 4,263,577 | 4/1981 | Bauchert et al. | 219/544 |
| 4,636,614 | 1/1987 | Itoh et al. | 219/270 |
| 4,650,963 | 3/1987 | Yokoi | 219/270 |
| 4,719,331 | 1/1988 | Ito et al. | 219/270 |
| 5,264,681 | 11/1993 | Nozaki et al. | 219/544 |
| 5,883,360 | 3/1999 | Tatematsu et al. | 219/270 |

FOREIGN PATENT DOCUMENTS

| | | |
|---|---|---|
| 1-225087 | 9/1989 | Japan . |
| 4-329291 | 11/1992 | Japan . |

*Primary Examiner*—Tu Ba Hoang
*Assistant Examiner*—Fadi H. Dahbour
*Attorney, Agent, or Firm*—Brinks Hofer Gilson & Lione

[57] ABSTRACT

A ceramic heater has a structure in which a resistance heating element mainly composed of a metal having a high melting point is embedded in a ceramic substrate. With an average grain size for component grains of the ceramic substrate taken as dB and that for component grains of the resistance heating element taken as dH, a dH/dB ratio is adjusted to not greater than 0.8.

6 Claims, 4 Drawing Sheets

CERAMIC HEATER

BACKGROUND OF THE INVENTION

1. Field of the Invention

The present invention relates to a ceramic heater, and more particularly to a ceramic heater for heating an oxygen sensor used with an automobile, for use in a glow system of a diesel engine, for heating a semiconductor substrate, for use in a fan heater, or the like.

2. Prior Art

The above-mentioned ceramic heater is known to have a structure in which a resistance heating element formed from a metal having a high melting point such as W (tungsten) is embedded in a ceramic substrate formed into a flat shape, a cylindrical shape, or other shape. Such a ceramic heater is manufactured, for example, by the steps of: forming an unfired ceramic compact through sheet forming, extrusion, or a like process; forming a heating element pattern on the ceramic compact through use of paste which contains a high-melting-point metal powder and through thick-film printing or a like method; placing another ceramic compact thereon to obtain a layered assembly; and firing the assembly.

Conventionally, when a ceramic heater of this kind has been used continuously at a high temperature over a long period of time, the resistance heating element has tended to deteriorate and suffer an increase in electric resistance, causing a shortening of service life of the heater. Such a deterioration in the resistance heating element is said to be caused by an electrochemical diffusion phenomenon, so-called electromigration (hereinafter, referred to merely as migration), in which a component of the resistance heating element or a component of the ceramic substrate electrochemically diffuses due to application of current for establishment of a high temperature (for example, in Japanese Patent Application Laid-Open No. 4-329291). For example, when a component of the resistance heating element diffuses into the ceramic substrate through migration, the resistance heating element is consumed at a portion from which the component has diffused out, and may suffer an excessive temperature rise or a disconnection. A metal oxide component, such as MgO or CaO, added as a sintering aid component is present in the form of glass phase within the ceramic substrate. Metal ions or oxygen ions contained in the glass phase also tend to migrate. For example, when the main component of the resistance heating element is W, the resistance heating element is oxidized by migrating oxygen ions and may suffer an increase in resistance, a disconnection, or a like problem.

SUMMARY OF THE INVENTION

In order to solve the above-mentioned problems, a first configuration of a ceramic heater of the present invention is characterized in that a resistance heating element mainly composed of a metal having a high melting point is embedded in a ceramic substrate and that, with an average grain size for component grains of the ceramic substrate taken as dB and that for component grains of the resistance heating element taken as dH, a dH/dB ratio is adjusted to not greater than 0.8.

An object of the present invention is to provide a ceramic heater in which the resistance heating element is less likely to deteriorate even after continuous use at high temperature over a long period of time and which provides a long service life.

BRIEF DESCRIPTION OF THE DRAWINGS

FIG. 1(*b*) is a sectional view of a ceramic heater of the present invention taken along line A—A of FIG. 1(*a*);

FIG. 3(*b*) is a plan view of a first manufacturing step of the modification of the ceramic heater of the present invention;

FIG. 3(*c*) is a sectional view of a second manufacturing step of the modification of the ceramic heater of the present invention;

FIG. 3(*d*) is a sectional view of a third manufacturing step of the modification of the ceramic heater of the present invention;

FIG. 4(*b*) is a sectional view of the other modification of a ceramic heater of the present invention taken along line B—B of FIG. 4(*a*).

DESCRIPTION OF THE PREFERRED AND ALTERNATE EMBODIMENT

Figure 1:
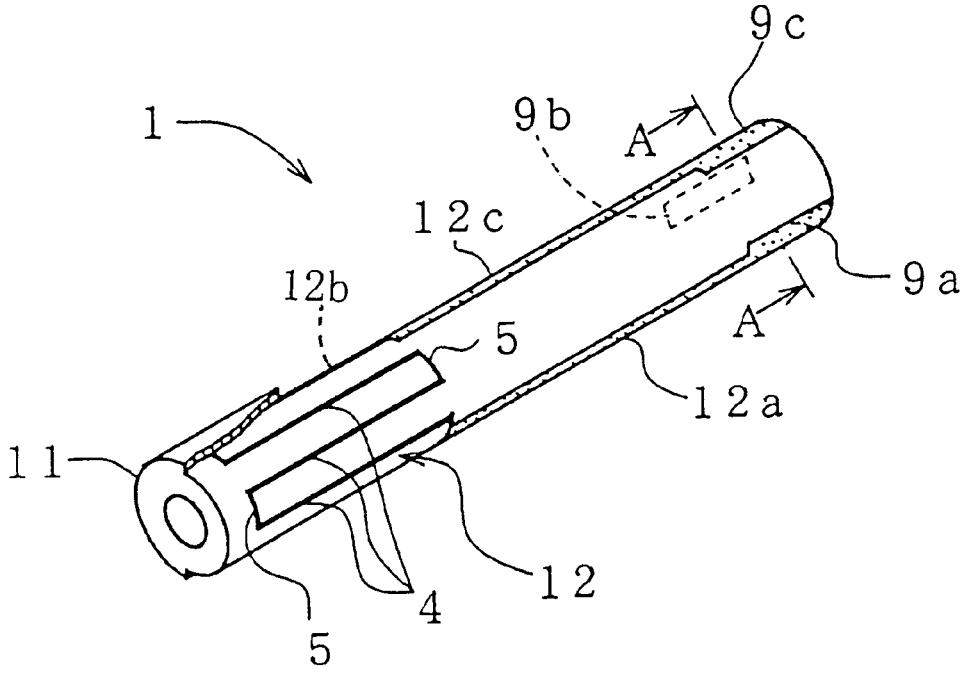
FIG. 1(*a*) is a partially cutaway perspective view showing an embodiment of a ceramic heater of the present invention.
Figure 1:
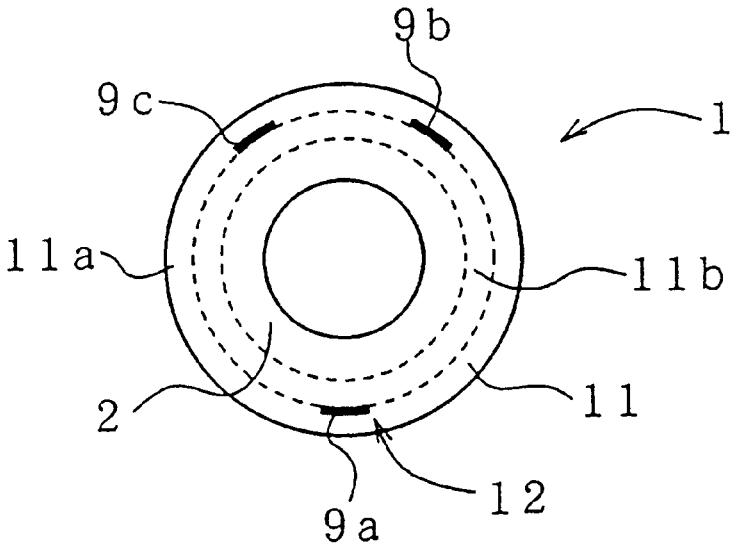

With an average grain size for component grains of the ceramic substrate taken as dB and that for component grains of the resistance heating element taken as dH, the dH/dB ratio is adjusted to not greater than 0.8. Therefore, the resistance heating element is less likely to deteriorate even in the case of use at high temperature over a long period of time, thereby realizing a ceramic heater having a long service life. Also, when the ceramic heater is manufactured through firing, the resistance heating element is less likely to suffer a disconnection, a variation in resistance or a like defect.

A typical high-melting point metal usable in the present invention is W, but Mo is also usable. W and Mo may be used singly or in combination. The ceramic substrate may be mainly composed of $Al_2O_3$ for excellence in thermal conductivity, strength at high temperature, and corrosion resistance at high temperature. Also, ceramic which contains an $Al_2O_3$ component, such as mullite, cordierite, or spinel may be used. The ceramic substrate may contain, as a sintering aid component, one or more of $SiO_2$, MgO, CaO, $B_2O_5$, etc. in a total amount of not greater than 15% by weight.

When the dH/dB ratio is in excess of 0.8, the resistance heating element is apt to deteriorate in the case of use at high temperature over a long period of time, causing a shortening of service life of the ceramic heater. When the ceramic heater is manufactured through firing, the resistance heating element has a high probability of suffering a disconnection, a variation in resistance, or a like defect. The dH/dB ratio is preferably adjusted to not greater than 0.7, more preferably not greater than 0.6.

In the ceramic heater of the present invention, the high-temperature durability of the resistance heating element is enhanced. Also, when the ceramic heater is manufactured through firing, a defect is less likely to occur. Conceivable reasons for such features are as follows:

(1) Through adjustment of the dH/dB ratio to not greater than 0.8, a size for component grains of the resistance heating element is set relatively small as compared to that for component grains of the ceramic substrate. Accordingly, spaces are less likely to be formed among component grains of the resistance heating element. Even when such spaces are formed, they are finely dispersed. Thus, during sintering, a sintering aid component in a liquid glass phase is less likely to penetrate into spaces formed among component grains of the resistance heating element.

(2) Employment of a relatively small grain size for component grains of the resistance heating element as described above means that grains of a material powder for the resistance heating element have a corresponding small size. During firing, grains of the material powder shrink, mainly because of a solid-phase sintering mechanism. In the solid-phase sintering mechanism, shrinkage is known to be more apt to progress as the grain size of powder decreases. Accordingly, through use of a material powder having a small grain size, firing promotes denseness (compactness) of the resistance heating element, whereby a glass phase is conceivably less likely to penetrate into the resistance heating element.

(3) Through adjustment of the dH/dB ratio to not greater than 0.8, there is conceivably apt to be formed a structure in which, in an interface between the ceramic substrate and the resistance heating element, component grains of the resistance heating element are microscopically entangled in between component grains of the ceramic substrate. In this state, when the resistance heating element is compacted through firing, an associated shrinkage stress causes a liquid glass phase present between component grains in the vicinity of the interface of the component grains to be pushed back toward the ceramic substrate side, thereby enhancing the tendency to expel the glass phase from the vicinity of the interface.

Presumably, because of at least one of these factors (1) through (3), an excessive glass phase is less likely to be formed in the interface between the ceramic substrate and the resistance heating element. As a result, migration is conceivably less likely to occur between the resistance heating element and the glass phase, thereby enhancing the high-temperature durability of the resistance heating element and suppressing the occurrence of defects during manufacture.

When the dH/dB ratio is in excess of 0.8, the amount of the glass phase present in the vicinity of the interface increases; consequently, a bonding force of the ceramic substrate with the resistance heating element drops. When the ceramic heater in such a state is held at high temperature for a long period of time, the resistance heating element enters a state similar to floating in the fluidized glass phase, and consequently the state of fixing the resistance heating element onto the ceramic substrate becomes unstable. As a result, the resistance heating element becomes susceptible to a bending force and a local stress concentration induced by the ceramic substrate, as well as to suffering a disconnection and a like defect. However, in the ceramic heater of the present invention in which the dH/dB ratio is not greater than 0.8, by virtue of, for example, the above factor (3), a bonding force of the resistance heating element with the ceramic substrate is enhanced through firing compaction effected while the interface is in the entangled state described above. Additionally, the amount of the glass phase present in the vicinity of the interface decreases. Thus, even when the state of the fluidized glass phase continues for a long period of time, the resistance heating element can retain the state of being firmly fixed in the ceramic substrate. This is conceivably another reason for the ceramic heater of the present invention being enhanced in high-temperature durability and being less susceptible to the occurrence of a defect during manufacture thereof.

Such an effect of the present invention is particularly notably achieved when the resistance heating is mainly composed of W and when the ceramic substrate is mainly composed of $Al_2O_3$.

Preferably, an average grain size dH for component grains of the resistance heating element is adjusted to 0.3 to 1.2 $\mu$m. When the dH value is in excess of 1.2 $\mu$m, the resistance heating element may deteriorate in the case of continuous high-temperature use over a long period of time or may suffer a disconnection, a variation in resistance, or a like defect during manufacture. This is conceivably because spaces are likely to be formed among component grains of the resistance heating element, and thus the glass phase penetrates the resistance heating element from the ceramic substrate side, thereby increasing the potential for migration between the resistance heating element and the glass phase. When the dH value is less than 0.3 $\mu$m, a material powder for the resistance heating element mainly composed of a high-melting-point metal is apt to be oxidized, and thus handling of the powder becomes difficult during manufacture. Shrinkage of an oxidation-deteriorated powder becomes difficult to effect during firing, and thus there may arise problems such as a shortening of service life induced by deterioration in the resistance generating element and an increase in the probability of defect occurrence during manufacture. The dH value is preferably adjusted to 0.4 to 0.7 $\mu$m.

Preferably, component grains of the resistance heating element are adjusted such that, in a grain size distribution, a difference between a grain size d90%, which shows a relative cumulative frequency of 90% as measured from the side of a small grain size, and a grain size d10%, which shows a relative cumulative frequency of 10% as measured from the side of a small grain size, i.e., a difference of d90%−d10%, is not greater than 1.5 $\mu$m. Through adjustment of the difference, d90%−d10%, to the range, the grain size distribution of component grains of the resistance heating element becomes acute, thereby further suppressing deterioration of the resistance heating element in the case of high-temperature use over a long period of time and the occurrence of a defect during manufacture. When the difference, d90%−d10%, is in excess of 1.5 $\mu$m, shrinkage of the resistance heating element becomes difficult to effect during firing, so that migration tends to occur. As a result, the service life of the resistance heating element may be shortened or there may increase the probability of defect occurrence during manufacture and a variation in resistance among ceramic heaters. The difference, d90%−d10%, is preferably adjusted to not greater than 1.2 $\mu$m, more preferably not greater than 0.8 $\mu$m.

A second configuration of a ceramic heater of the present invention is characterized in that a resistance heating element mainly composed of a metal having a high melting point is embedded in a ceramic substrate; an average grain size dH for component grains of the resistance heating element is adjusted to 0.3 to 1.2 $\mu$m; and component grains of the resistance heating element are such that, in a grain size distribution, a difference between a grain size d90%, which shows a relative cumulative frequency of 90% as measured from the side of a small grain size, and a grain size d10%, which shows a relative cumulative frequency of 10% as measured from the side of a small grain size, i.e., a difference of d90%−d10%, is not greater than 1.5 $\mu$m. Through adjustment of the size of component grains of the resistance heating element so as to obtain a dH value of 0.3 to 1.2 μm and a difference, d90%–d10%, of not greater than 1.5 μm, the resistance heating element is less likely to deteriorate even in the case of use at high temperature over a long period of time, thereby realizing a ceramic heater having a long service life. Also, when the ceramic heater is manufactured through firing, the resistance heating element is less likely to suffer a disconnection or a like defect, and a variation in resistance among ceramic heaters is less likely to occur.

Also, in the configuration, when the dH value is in excess of 1.2 μm, the resistance heating element may deteriorate in the case of continuous high-temperature use over a long period of time or may suffer a disconnection, a variation in resistance, or a like defect during manufacture. When the dH value is less than 0.3 μm, a material powder for the resistance heating element mainly composed of a high-melting-point metal is apt to be oxidized, and thus handling of the powder becomes difficult during manufacture. The dH value is preferably adjusted to 0.4 to 0.7 μm. When the differences, d90%–d10%, is in excess of 1.5 μm, shrinkage of the resistance heating element becomes difficult to effect during firing, so that migration tends to occur. As a result, the service life of the resistance heating element may be shortened, or there may increase the probability of defect occurrence during manufacture and a variation in resistance among ceramic heaters. The difference, d90%–d10%, is preferably adjusted to not greater than 1.2 μm, more preferably not greater than 0.8 μm.

Notably, one or more of high-melting-point metal components such as Re, Pt, or Rh may be added to a material for the resistance heating element in a predetermined amount (for example, not greater than 25% by weight with respect to a total amount of W and Mo). This improves the high-temperature corrosion resistance of the resistance heating element, thereby extending the service life of the ceramic heater. For example, when the resistance heating element is mainly composed of W, the effect of improving the corrosion resistance and high-temperature strength of the element becomes particularly notable through addition of Re. However, since Re, Pt, and Rh are all precious metals, their addition in excess of 25% by weight causes an increase in manufacturing cost for the resistance heating element, and further improvement in performance of the resistance heating element cannot be expected, and the performance of the resistance heating element may be even impaired.

Next, a material for the resistance heating element may contain, in an amount of not greater than 25% by weight, ceramic whose main component is used in common with the ceramic substrate. "Main component is used in common" means that the type of a ceramic component of a largest content is identical. Thus, there can be reduced a difference in coefficient of linear expansion between the resistance heating element and the ceramic substrate, thereby suppressing damage to the resistance heating element which would otherwise result when heating and cooling are repeated, and suppressing a variation in resistance during manufacture. However, when the content is in excess of 25% by weight, the resistivity of the resistance heating element increases, causing a decrease in heat generation efficiency.

Embodiments of the present invention will next be described with reference to drawings.

FIG. 1 shows an embodiment of a ceramic heater of the present invention. A ceramic heater 1 includes a cylindrical ceramic substrate 11 and a resistance heating element 12 which is embedded in the circumferential surface of the ceramic substrate 11 at a radially intermediate portion. Specifically, as shown in FIG. 1(*b*), the ceramic substrate 11 includes a cylindrical core 2 and two ceramic layers 11*a* and 11*b*, which are wound onto the outer circumferential surface of the core 2 in a layered form to thereby be integrated with the core 2. The resistance heating element 12 is disposed between the ceramic layers 11*a* and 11*b*.

As shown in FIG. 1(*a*), the resistance heating element 12 is formed in the following manner. A plurality of main body portions 4 extend in an axial direction of the ceramic substrate 11, are arranged at substantially equal intervals in the circumferential direction, and are sequentially connected to each other such that adjacent main body portions 4 are connected at both end portions by means of connection portions 5, thereby making a continuous zigzag form. Three lead portions 12*a*, 12*b*, and 12*c* for connection to a power source integrally extend from the rear end side of the resistance heating element 12 in the axial direction of the ceramic substrate 11 (the lead portion 12*b* is hidden). Terminal portions 9*a*, 9*b*, and 9*c*, which are somewhat wider, are formed at end sections of the lead portions 12*a*, 12*b*, and 12*c*, respectively.

In the ceramic heater 1, the resistance heating element 12 is mainly composed of a metal having a high melting point, for example, W. The ceramic substrate 11 is mainly composed of $Al_2O_3$ and contains, as a sintering aid component, one or more of $SiO_2$, MgO, CaO, $B_2O_5$, etc. in a total amount of not greater than 15% by weight. With an average grain size for component grains of the ceramic substrate 11 taken as dB and that for component grains of the resistance heating element 12 taken as dH, a dH/dB ratio is preferably adjusted to not greater than 0.8, more preferably not greater than 0.6. The average grain size dH for component grains of the resistance heating element 12 is preferably 0.3 to 1.2 μm, more preferably 0.4 to 0.7 μm. Further, component grains of the resistance heating element 12 is adjusted such that in a grain size distribution, a difference between a grain size d90%, which shows a relative cumulative frequency of 90% as measured from the side of a small grain size, and a grain size d10%, which shows a relative cumulative frequency of 10% as measured from the side of a small grain size, i.e., a difference of d90%–d10%, is not greater than 1.5 μm.

In the ceramic heater 1 having the above structure, the resistance heating element 12 is less susceptible to deteriorate even in the case of use at high temperature over a long period of time, thereby extending the service life of the ceramic heater 1. Also, when the ceramic heater 1 is manufactured through firing, the resistance heating element 12 is less susceptible to suffering a disconnection, a variation in resistance, or a like defect.

Figure 2:
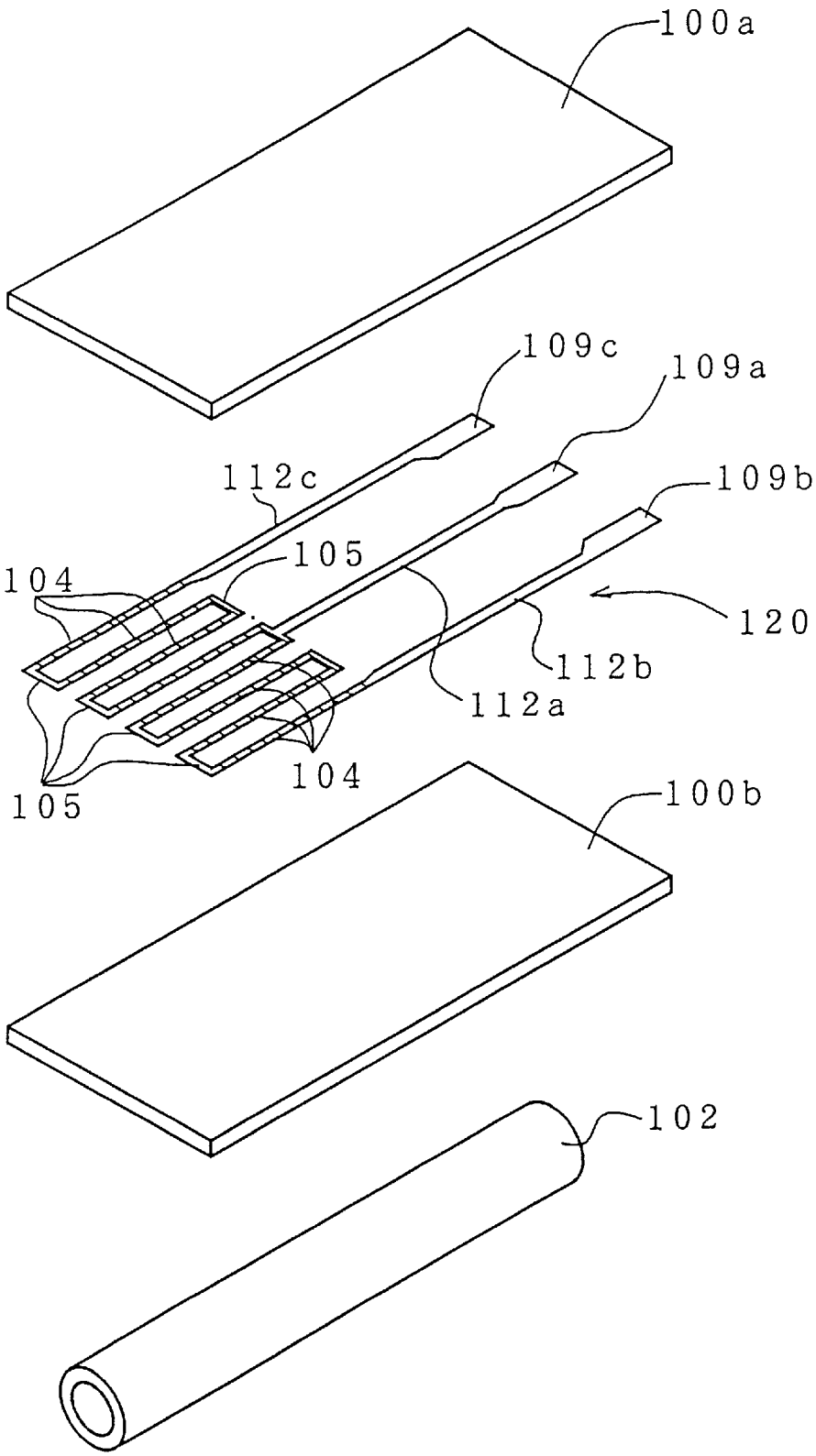
FIG. 2 is an exploded perspective view showing an example method for manufacturing the ceramic heater of FIG. 1.

The ceramic heater 1 can be manufactured, for example, in the following manner. As shown in FIG. 2, a ceramic powder, together with a binder, is sheeted to obtain a powder compact 100*b*. Through use of a paste which contains a material powder for the resistance heater 12, a pattern 120 (including portions 104, which will become the main body portions 4, portions 105, which will become the connection portions 5, portions 112*a*, 112*b*, and 112*c*, which will become the lead portions 12*a*, 12*b*, and 12*c*, and portions 109*a*, 109*b*, and 109*c*, will become the terminals portions 9*a*, 9*b*, and 9*c*) of a resistance heating element is printed on a surface of the powder compact 100*b*. Terminal metal pieces (not shown) are arranged on the corresponding portions 109*a*, 109*b*, and 109*c*. Next, another sheeted powder compact 100*a* is placed on the surface of the powder compact 100*b* on which the pattern 120 is formed, to thereby obtain a laminate. The laminate is wound onto the outer circumference of a cylindrical compact 102, which will serve as the core 2, followed by firing in a predetermined firing furnace. Thus, the compacts 100*a,* 100*b,* and 102 are united to become the ceramic substrate 11, and the printed pattern 120 becomes the resistance heating element 12, the lead portions 12*a,* 12*b,* and 12*c,* and the terminal portions 9*a,* 9*b,* and 9*c.*

Figure 3:
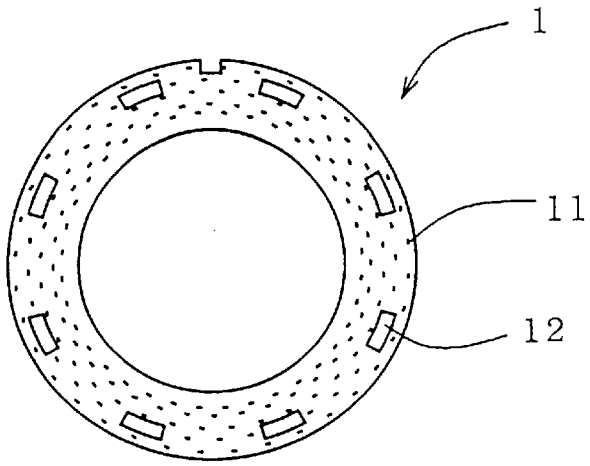
FIG. 3(*a*) is a sectional view showing a modification of the ceramic heater of the present invention.
Figure 3:
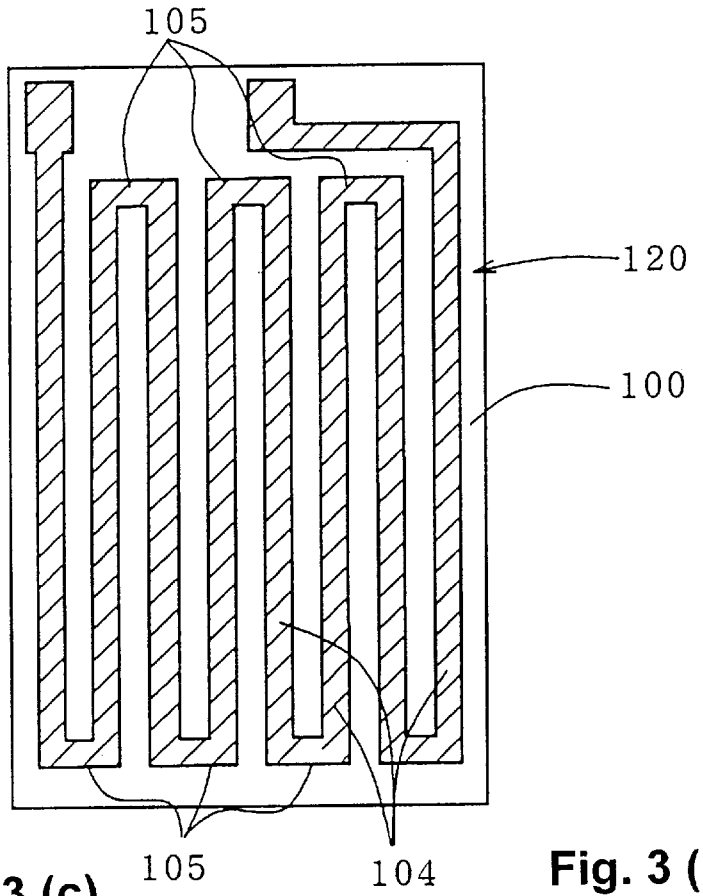
Figure 3:
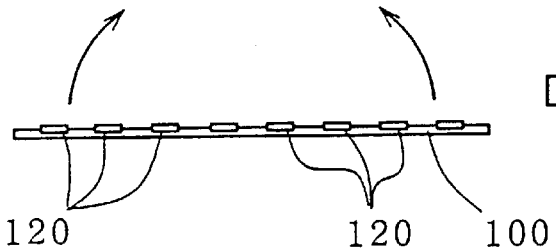
Figure 3:
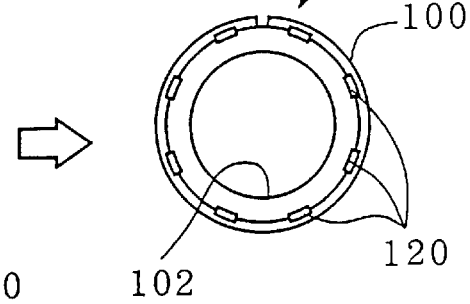

Notably, the ceramic heater 1 may be manufactured in the following manner. As shown in FIG. 3(*b*), a pattern 120 of a resistance heating element is printed on a sheet surface of a powder compact 100. Next, as shown in FIG. 3(*c*), the powder compact 100 is wound onto the outer circumferential surface of a separately formed cylindrical compact 102 such that the surface bearing the pattern 120 comes inside, thereby making a cylindrical compact 103 as shown in FIG. 3(*d*). The thus-obtained compact 103 is fired, thereby obtaining a ceramic heater 1 shown in FIG. 3(*a*).

Figure 4:
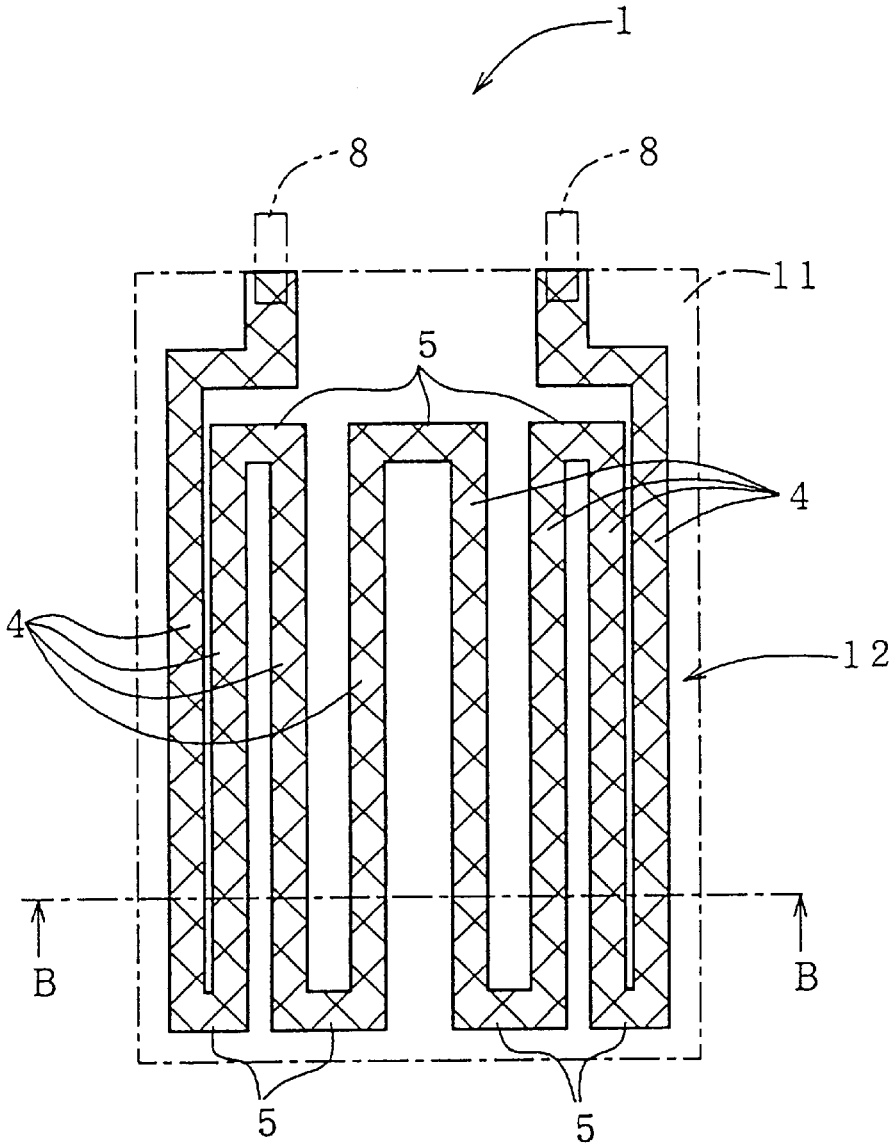
FIG. 4(*a*) is a schematic view showing another modification of the ceramic heater of the present invention.
Figure 4:
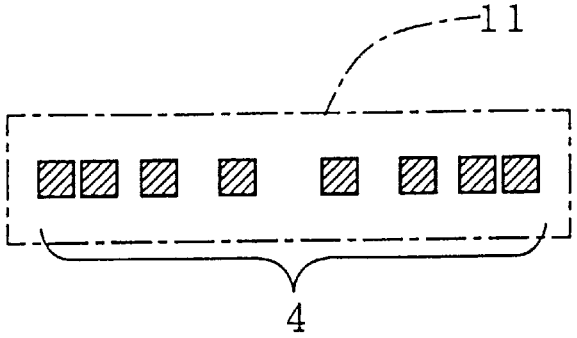

FIG. 4 shows an example of a sheet-shaped ceramic heater 1. Specifically, the ceramic heater 1 includes a ceramic substrate (hereinafter, referred to merely as a substrate) 11 having a square (for example, rectangular) sheet shape and a resistance heating element 12 which is embedded in the substrate 11 at an intermediate portion in the thicknesswise direction. Portions used in common with the ceramic heater 1 of FIG. 1 are denoted by common symbols, and their description is omitted. Numeral 8 denotes terminal metal pieces.

EXAMPLES

Various kinds of the ceramic heaters 1 shown in FIG. 1 were manufactured.

The powder compacts 100*a* and 100*b* of FIG. 2 were manufactured in the following manner. First, an $Al_2O_3$ powder (average grain size: 1.0 μm or 1.8 μm) and sintering aid components of $SiO_2$ (average grain size: 1.4 μm), $CaCO_3$ (average grain size: 3.2 μm; $CaCO_3$ becomes CaO through firing), $MgCO_3$ (average grain size: 4.1 μm; $MgCO_3$ becomes MgO through firing), and $Y_2O_3$ were blended in predetermined amounts. The composition was adjusted such that a ceramic substrate after firing contains $SiO_2$, CaO, MgO, and $Y_2O_3$ in a total amount of 4% to 15% by weight. To the resulting mixed powder were added a predetermined solvent and a predetermined binder. The resulting mixture was slurried through use of a ball mill. The thus-obtained slurry substance is defoamed under reduced pressure and sheeted into powder compacts 100*a* and 100*b,* each having a thickness 0.3 mm, through doctor blading.

Next, ink for printing the pattern 120 of a resistance heating element was prepared in the following manner. To each of W powders having various grain-size distributions was added, as needed, an Re powder (average grain size: 1.5 μm) or an $Al_2O_3$ powder (average grain size: 1.5 μm) in a predetermined amount. To the resulting mixture were added a solvent and a binder in respectively predetermined amounts. The mixture was slurred through use of a ball mill. Subsequently, acetone was evaporated, obtaining an ink paste.

As shown in FIG. 2, through use of the above ink, the pattern 120 having a thickness of 25 μm was screen-printed on the surface of the powder compact 100*b*. Further, unillustrated terminal metal pieces were arranged in place, and the powder compact 100*a* was placed on the powder compact 100*b*. The thus-obtained laminate was wound onto the separately manufactured cylindrical compact 102 to obtain an unfired assembly. The assembly was subjected to a binder-removing process at 250° C. and then fired at 1550° C. for 1.5 hours in a hydrogen-containing atmosphere, thereby manufacturing various kinds of test products of the ceramic heater 1 shown in FIG. 1 (200 test products were manufactured for each kind). The size of the ceramic heater 1 is adjusted to an outer diameter of 2.6 mm and a length of 60 mm, and the size of the resistance heating element 12 is adjusted such that the main body portion 4 has a width of 0.3 mm and a length of 20 mm.

Some of the ceramic heaters 1 were cut. Cut surfaces were polished and observed through use of a scanning electron microscope (SEM). SEM images were measured a grain size distribution and a median (d50%; a grain size whose relative cumulative frequency as measured from the side of a small grain size is 50%; substantially equal to the average grain size dH) for component grains of the resistance heating element 12 and the average grain size dB for component grains of the ceramic substrate 11. An SEM image of a section of the ceramic substrate 11 were input to an analyzer. Through use of the analyzer, an area S of each grain appearing on the section was measured, and a diameter d of each grain was obtained through the calculation, $2\times S/\pi)^{1/2}$ (the diameter of a circle having the area S). A voltage of 24V was applied to the ceramic heaters 1 for up to 100 hours, thereby obtaining a percentage of the ceramic heaters 1 damaged by a disconnection or the like and a standard deviation of heater resistance. The results are shown in Table 1.

TABLE 1

| | Grain size of heating element (unit: μm) | | | | Ave. grain size of substrate | | Additives | | | Standard deviation of |
|---|---|---|---|---|---|---|---|---|---|---|
| | d90% | d50% (dH) | d10% | d90%–d10% | dB | dH/dB | Re (wt %) | $Al_2O_3$ (wt %) | Breakage ratio (%) | resistance (Ω) |
| 1 | 0.4 | 0.2 | 0.1 | 0.3 | 1.8 | 0.11 | — | — | 0 | 0.09 |
| 2 | 0.5 | 0.3 | 0.1 | 0.4 | 1.8 | 0.17 | — | — | 0 | 0.10 |
| 3 | 1.2 | 0.8 | 0.5 | 0.7 | 1.8 | 0.44 | — | — | 0 | 0.13 |
| 4 | 1.4 | 1.0 | 0.6 | 0.8 | 1.8 | 0.56 | — | — | 3 | 0.15 |
| 5 | 1.9 | 1.2 | 0.7 | 1.2 | 1.8 | 0.67 | — | — | 8 | 0.17 |
| 6 | 2.6 | 1.6 | 0.9 | 1.7 | 1.8 | 0.89 | — | — | 60 | 0.35 |
| 7 | 4.1 | 2.3 | 1.6 | 2.5 | 1.8 | 1.28 | — | — | 50 | 0.52 |
| 8 | 0.4 | 0.2 | 0.1 | 0.3 | 1.0 | 0.2 | — | — | 0 | 0.10 |
| 9 | 0.5 | 0.3 | 0.1 | 0.4 | 1.0 | 0.3 | — | — | 0 | 0.11 |
| 10 | 1.2 | 0.8 | 0.5 | 0.7 | 1.0 | 0.8 | — | — | 9 | 0.12 |
| 11 | 1.4 | 1.0 | 0.6 | 0.8 | 1.0 | 1.0 | — | — | 30 | 0.30 |
| 12 | 0.7 | 0.5 | 0.3 | 0.4 | 1.8 | 0.27 | — | 10 | 0 | 0.12 |

TABLE 1-continued

| | Grain size of heating element (unit: μm) | | | | Ave. grain size of substrate | | Additives | | Breakage | Standard deviation of resistance |
|---|---|---|---|---|---|---|---|---|---|---|
| | d90% | d50% (dH) | d10% | d90%–d10% | dB | dH/dB | Re (wt %) | $Al_2O_3$ (wt %) | ratio (%) | (Ω) |
| 13 | 1.2 | 0.8 | 0.5 | 0.7 | 1.8 | 0.44 | — | 10 | 3 | 0.14 |
| 14 | 2.6 | 1.7 | 1.0 | 1.6 | 1.8 | 0.89 | — | 10 | 35 | 0.38 |
| 15 | 0.7 | 0.5 | 0.3 | 0.4 | 1.8 | 0.27 | 10 | — | 0 | 0.11 |
| 16 | 1.2 | 0.8 | 0.5 | 0.7 | 1.8 | 0.44 | 10 | — | 2 | 0.14 |
| 17 | 2.6 | 1.7 | 1.0 | 1.6 | 1.8 | 0.89 | 10 | — | 28 | 0.42 |

As seen from the above results, the ceramic heaters 1 having a dH/dB of not greater than 0.8 exhibit a lower damage percentage with respect to the resistance heating element 12 and a smaller variation (standard deviation) in resistance of the resistance heating element 12 as compared to the ceramic heaters 1 having a dH/dB in excess of 0.8. In other words, through adjustment of the dH/dB ratio to not greater than 0.8, the resistance heating element 12 becomes less susceptible to deterioration even in the case of use at high temperature over a long period of time, and the resistance heating element becomes less susceptible to suffering a disconnection, a variation in resistance, or a like defect during manufacture through firing.

The ceramic heaters 1 in which the average grain size dH for component grains of the resistance heating element 12 falls within the 0.3 to 1.2 μm range exhibit a lower damage percentage with respect to the resistance heating element 12 and a smaller variation in resistance of the resistance heating element 12 as compared to the ceramic heaters 1 in which the average grain size dH falls outside the range. Further, the ceramic heaters 1 in which a grain size distribution for component grains of the resistance heating element 12 is adjusted such that the difference, d90%–d10%, is not greater than 1.5 μm, exhibit a lower damage percentage with respect to the resistance heating element 12 and a smaller variation in resistance of the resistance heating element 12 as compared to the ceramic heaters 1 in which the difference, d90%–d10%, is in excess of 1.5 μm.

The foregoing disclosure is the best mode devised by the inventors for practicing this invention. It is apparent, however, that devices incorporating modifications and variations will be obvious to one skilled in the art of ceramic heaters. Inasmuch as the foregoing disclosure presents the best mode contemplated by the inventors for carrying out the invention and is intended to enable any person skilled in the pertinent art to practice this invention, it should not be construed to be limited thereby but should be construed to include such aforementioned obvious variations and be limited only by the spirit and scope of the following claims.

We claim:

1. A ceramic heater characterized in that a resistance heating element mainly composed of a metal having a high melting point is embedded in a ceramic substrate and that, with an average grain size for component grains of said ceramic substrate taken as dB and that for component grains of said resistance heating element taken as dH, a dH/dB ratio is adjusted to not greater than 0.8 and wherein a difference in size of component grains of said resistance heating element between a grain size having a relative cumulative frequency of 90% and grain size having a relative cumulative frequency of 10% is not greater than 1.5 μm.

2. A ceramic heater as described in claim 1 wherein a material for said resistance heating element contains Re in an amount of not greater than 25% by weight.

3. A ceramic heater as described in claim 1, wherein the average grain size dH for component grains of said resistance heating element is adjusted to 0.3 to 1.2 μm.

4. A ceramic heater as described in claim 3 wherein a material for said resistance heating element contains Re in an amount of not greater than 25% by weight.

5. A ceramic heater characterized in that a resistance heating element mainly composed of a metal having a high melting point is embedded in a ceramic substrate; an average grain size dH for component grains of said resistance heating element is adjusted to 0.3 to 1.2 μm; and component grains of said resistance heating element are such that, in a grain size distribution, a difference between a grain size having a relative cumulative frequency of 90% and grain size having a relative cumulative frequency of 10% is not greater than 1.5 μm.

6. A ceramic heater as described in claims 1, 2, 3, 4 or 5, wherein a material for said resistance heating element contains, in an amount of not greater than 25% by weight, ceramic whose main component is used in common with said ceramic substrate.

* * * * *